US007434810B2

(12) United States Patent
DeMille et al.

(10) Patent No.: US 7,434,810 B2
(45) Date of Patent: Oct. 14, 2008

(54) AIRGUN RANGE

(76) Inventors: Dennis DeMille, 780 Aldea Dr., Oceanside, CA (US) 92057; Greg Kantorovich, 1539 Vivaldi St., Cardiff, CA (US) 92007

( * ) Notice: Subject to any disclaimer, the term of this patent is extended or adjusted under 35 U.S.C. 154(b) by 126 days.

(21) Appl. No.: 11/508,064

(22) Filed: Aug. 22, 2006

(65) Prior Publication Data

US 2008/0073848 A1 Mar. 27, 2008

(51) Int. Cl.
*F41J 1/14* (2006.01)

(52) U.S. Cl. ..... 273/404; 273/407; 273/410; 273/403

(58) Field of Classification Search ..... 273/378–392, 273/403–410; D22/112–115; D21/306
See application file for complete search history.

(56) References Cited

U.S. PATENT DOCUMENTS

| | | | | | |
|---|---|---|---|---|---|
| 841,611 | A * | 1/1907 | Alsop | 273/410 |
| 1,656,718 | A * | 1/1928 | Bickford | 473/164 |
| 1,886,562 | A * | 11/1932 | Lefever | 273/382 |
| 2,284,510 | A * | 5/1942 | Cates | 273/407 |
| 2,397,921 | A * | 4/1946 | Cole | 273/410 |
| 2,827,297 | A * | 3/1958 | Foster | 273/401 |
| 2,901,254 | A * | 8/1959 | Fortson | 273/404 |
| 3,122,367 | A * | 2/1964 | Dale | 273/394 |
| 3,455,554 | A * | 7/1969 | Rademacher | 273/386 |
| 3,540,729 | A * | 11/1970 | Rahberger | 273/407 |
| 4,022,472 | A * | 5/1977 | Seals | 273/400 |
| 4,625,974 | A * | 12/1986 | Andrews | 273/407 |
| 4,744,568 | A * | 5/1988 | Bernahl et al. | 273/404 |
| D329,680 | S * | 9/1992 | Burn | D22/113 |
| 5,280,919 | A * | 1/1994 | Graham | 273/381 |
| 5,564,712 | A * | 10/1996 | Werner | 273/410 |
| 6,435,512 | B1 * | 8/2002 | Beckwith, Sr. | 273/407 |
| D487,794 | S * | 3/2004 | Price | D22/113 |
| 2007/0132187 | A1 * | 6/2007 | Byram et al. | 273/407 |
| 2008/0007005 | A1 * | 1/2008 | Hsiao | 273/390 |

* cited by examiner

*Primary Examiner*—Mark S Graham
(74) *Attorney, Agent, or Firm*—Stetina Brunda Garred & Brucker

(57) ABSTRACT

A portable air gun range is provided to allow individuals to use in virtually any open space. The air gun range has a support frame, a central vertical pole, a curtain to be hung over the support frame behind the central vertical pole, and a target box removably attached to the central vertical pole. A plurality of bars are detachably connected together to construct the support frame with a rectangular profile. The central vertical pole is detachably connected to substantially the centers of a top side and a bottom side of the support frame. The curtain is made of high-density ballistic material and removably attached to the support frame, so as to vertically extend between the support frame and the central vertical pole.

23 Claims, 3 Drawing Sheets

AIRGUN RANGE

CROSS-REFERENCE TO RELATED APPLICATIONS

Not Applicable

STATEMENT RE: FEDERALLY SPONSORED RESEARCH/DEVELOPMENT

Not Applicable

BACKGROUND

The present invention relates in general to an air gun range, and more particularly, to a portable range system which allows individuals or groups to quickly assemble a safe, single or multiple firing point range, of virtually any size in virtually any adequately sized open space.

Air guns, as opposed to "bb guns", have the accuracy of a high power rifle or pistol that uses conventional ammunition, but present fewer problems with regards to hazmat, ricochets, danger zones, and noise pollution. These advantages make them ideal for youth competitions at all levels including high-school, collegiate level, and even Olympic competition. They are also valuable marksmanship training devices currently being used by Army, Marine Corps, Air Force, and navy Junior Recruit Officer Training Cadet programs (JROTC).

As the number of organized air rifle and pistol teams/programs is growing, so is the reluctance of schools to allow these programs. Fear of lawsuits, damage caused by errant shots, and the stigma attached to guns, are some of the major reason schools deny the creation of such programs. Compounding the problem is the complete absence of a safe, portable, and cost effective target system, as well as a lack of available space to conduct training. Construction costs make it necessary for schools to make the most out every square foot of building space. Because of the substantial amount of space required to construct a shooting range they are often constructed in spaces primarily designed for other uses, such cafeterias or gymnasiums. These spaces then become dual purpose areas and thus need to be converted to a shooting range prior to training and returned to its original condition once training has been completed. The time it takes to set up and take down a range cuts into valuable and limited training time. Schools that currently allow ranges to be constructed rely heavily on the judgment and knowledge on the individual supervising the marksmanship training to provide a safe and effective training environment. A top down review by the leaders of these marksmanship training programs found that very few of these ranges met even minimal safety standards. The ones that did meet minimum standards did so through the use of self-designed, untested, and unapproved backdrops or systems. A typical backdrop is often nothing more than a carpet hung behind the target line to prevent damage from errant shots. Some even use backdrops as flimsy as plastic shower curtains, some use nothing at all.

There is thus a substantial need to provide an air gun range which can be easily assembled and dissemble by an individual in a very short time, preferably within minutes. Also, it is expected that such air gun range provides sufficient safety to prevent the users and any individuals in the proximity from being injured by the air gun shooting.

BRIEF SUMMARY

The present invention addresses the foregoing needs by providing a quickly and easily constructed portable air gun range that allows individuals to use in virtually any open space. The air gun range comprises a support frame, a central vertical pole, a curtain to be hung over the support frame behind the central vertical pole, and a target box removably attached to the central vertical pole. A plurality of bars are detachably connected together to construct the support frame with a rectangular profile. The central vertical pole is detachably connected to substantially the centers of a top side and a bottom side of the support frame. The curtain is made of high-density ballistic material and removably attached to the support frame. Dimensionally the height of the curtain extends between the horizontal top and bottom pieces and to a width of about 2" past either vertical pole. Velcro strips are mounted on the 2" wide additional material and used to join several curtains together; thus creating a backdrop of unlimited width behind a target line.

In one embodiment, the support frame further comprises a pair of vertical sides, a horizontal top side with two opposing ends connected to the top ends of the respective vertical sides, and a horizontal bottom side with two opposing ends connected to the bottom ends of the respectively vertical sides. A pair of upper corner pieces is preferably used for connecting the horizontal top side to the vertical sides. Preferably, each of the upper corner pieces is bent into a horizontal connection member for connecting the top horizontal side and a vertical connection member for connecting the respective vertical side. The horizontal connection member is preferably further bent with an elbow configuration, such that the top horizontal side extends horizontally and laterally away from the vertical sides. That is, there exists a lateral distance between the planes where the top horizontal side and the vertical sides extend. The support frame may further comprise a pair of bottom stands for connecting the vertical sides to the bottom horizontal side. Each of the bottom stands further comprises a horizontal bar to extend perpendicularly to the bottom horizontal side, a horizontal connection member extending horizontally and perpendicularly from the horizontal bar, and a vertical connection member extending vertically from the horizontal bar. The horizontal connection member preferably extends from substantially a center of the horizontal bar, and the vertical connection member extends from between the center and one end of the horizontal bar. Therefore, similar to the top horizontal side, the bottom horizontal side protrudes horizontally away from the vertical sides.

The air gun range further comprises a plurality of bolts for tightening the bars to form the support frame. The central target pole is also assembled by a plurality of bars secured to each other. The central target pole further comprises a top lug extending horizontally from a top end thereof and a bottom lug extending horizontally from a bottom end thereof for connecting the top and bottom horizontal sides of the support frame by bolts, respectively. The bars are preferably made of 1" square steel tubing with a thickness of about 0.095". The female pieces used to join the bars together are preferably made of 0.75" square steel tubing with a length of about 6" and a thickness of about 0.095". Both the support frame and the central target pole are power coated for corrosion resistance. The curtain is preferably made of high-density ballistic nylon operative to withstand impacts from pellets with a muzzle velocity up to about 600 fps. In addition, the curtain may further include an edged Velcro, such that multiple curtains can be joined together to create a backdrop of unlimited width.

The target box is preferably partitioned into two chambers by a central plate. Each of the chambers is covered with a target surface perforated with a plurality of holes and includes a slot for disposing a cardboard about 1" behind the target surface and an impact plate behind the impact plate. The impact plates preferably have a thickness of 3 mm and a Brinnel rating of 500 to meet with Brinnel rating of 360/400 required by Marine Corps Range Safety Officer. A hook is preferably mounted at a rear surface of target box, such that the target box can easily be hung at the roll pins of the central pole. In an alternate embodiment, a single-chamber box with similar dimension may also be used for the target box.

A support frame is also provided allowing an individual to construct an air gun range quickly, preferably within minutes, in virtually any open space. The support frame includes a rectangular peripheral frame assembled by a plurality bars and a target pole connected to a top side and a bottom side of the rectangular peripheral frame. Preferably, the target pole protrudes horizontally and laterally from the rectangular peripheral frame, such that a curtain can be disposed to vertically extend behind the central pole which is used to attach a target box. The rectangular peripheral frame further comprises two vertical sides, the top side connected to the top ends of the vertical sides, and the bottom side connected to bottom ends of the vertical sides. Preferably, the top side and the bottom side protrude horizontally and laterally between the vertical sides and the target pole. To attach a target box, the target pole further comprises at least one pair of roll pins for attaching a target box, and the roll pins can be attached to the target pole at various heights set forth in the NRA3 position rule book.

BRIEF DESCRIPTION OF THE DRAWINGS

These and other features and advantages of the various embodiments disclosed herein will be better understood with respect to the following description and drawings, in: which like numbers refer to like parts throughout, and in which.

DETAILED DESCRIPTION

The detailed description set forth below is intended as a description of the presently preferred embodiment of the invention, and is not intended to represent the only form in which the present invention may be constructed or utilized. The description sets forth the functions and sequences of steps for constructing and operating the invention. It is to be understood, however, that the same or equivalent functions and sequences may be accomplished by different embodiments and that they are also intended to be encompassed within the scope of the invention.

Figure 1:
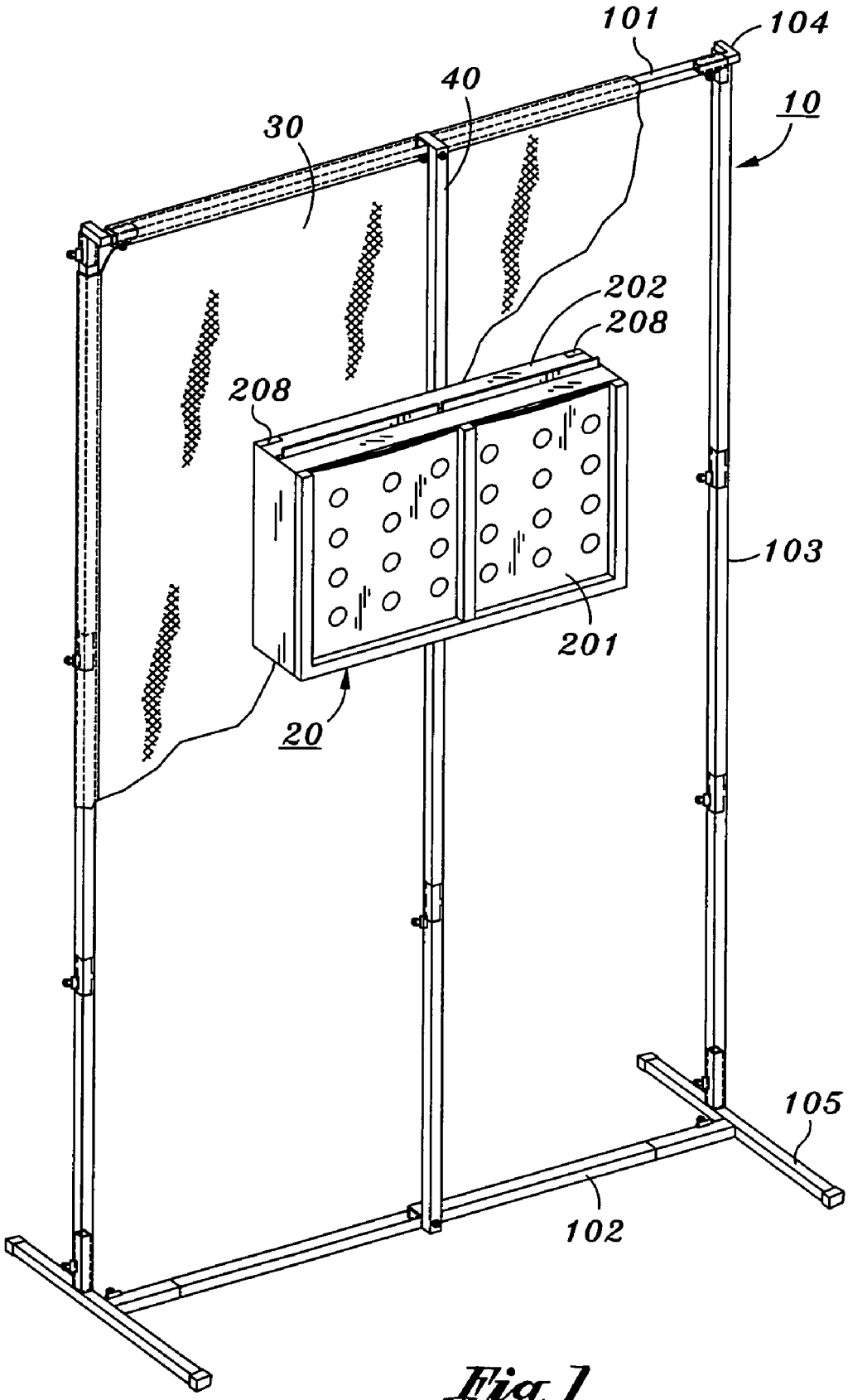
FIG. 1 shows a perspective view of a portable and collapsible air gun range.

Referring now to the drawings, and initially to FIG. 1, there is illustrated a perspective view of a portable air gun range which can be easily assembled and dissembled by an individual in minutes. The air gun range provides a level of safety that currently does not exist in many other types of air gun ranges and encourage schools to offer a marksmanship training program. With the Marine Corps Range and Training Area management Division's Range Safety Manager's seal approval, the air gun range as provided makes it easier to hold competitions/training events in areas currently off limits such as fitness centers, barracks, mess halls, etc . . . , virtually anywhere with an open space.

As shown in FIG. 1, the air gun range includes a support frame 10, a target box 20, a curtain 30 removably attached to the support frame 10 behind the target box 20, and a central target pole 40 for removably attaching the target box 20. The support frame 10 includes a horizontal top side 101, a horizontal bottom side 102, two vertical sides 103, two top corner pieces 104 connecting two the top horizontal side 101 to the respective vertical sides 103, and two bottom stands 105 connecting the vertical sides 103 to the bottom horizontal side 102. The central target pole 40 having two opposing ends connected to substantially the centers of the top horizontal side 101 and the bottom horizontal side, respectively. Preferably, the central target pole 40 protrudes farther laterally away from the vertical sides 103 compared to the top and bottom horizontal sides 101 and 102. The target box 20 has a front surface 201 serving as the target surface of an air gun and a rear surface 202 removably attached to the central pole 40.

Figure 2:
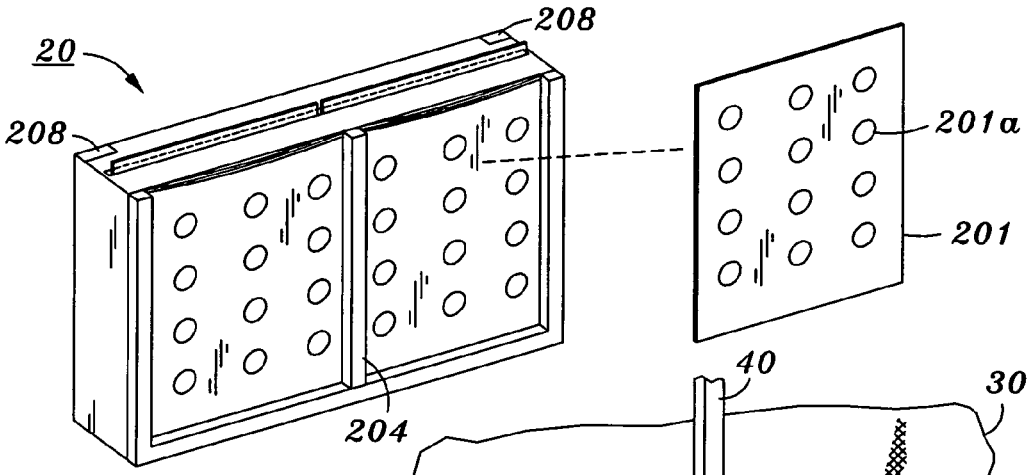
FIG. 2 shows a target box of the air gun range as shown in FIG. 1.
Figure 4:
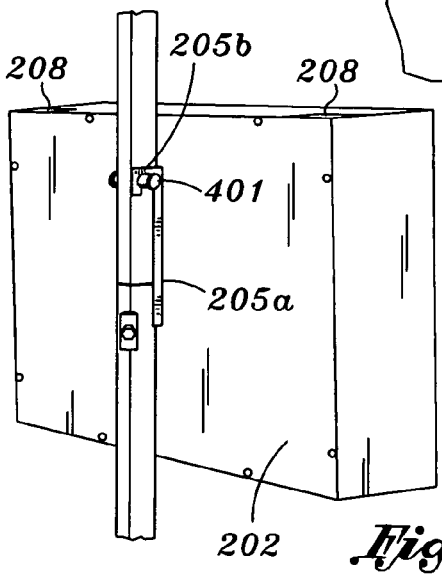
FIG. 4 shows the attachment of the target box to a support frame of the air gun range.

Referring to FIGS. 1 and 2, the target box 20 is in the form of a rectangular box partitioned into two chambers by a central plate 204. Although the target box 20 is preferably made of ¾" plywood, other wooden material, synthetic material or alternate material with alternate thickness may also be applicable for making the target box 20. To attach the target box 20 to the central target pole 106 of the support frame 10, attaching devices 107 and 205 are preferably formed or installed on the central target pole 40 and the rear surface 202 of the target box 20, respectively. In the embodiment as shown in FIG. 4, the attaching devices 107 includes a pair of roll pins 107 extending horizontally from two opposing sides of the central target pole 40, and the attaching device 205 includes a receiving member 205A for receiving a front portion of the central target pole 40 therein and two hook members 205B extending from the top of the receiving member 205A to hook the target box 20 on the attaching devices 107. Preferably, the roll pins 107 can be placed at or adjusted to various heights such as the heights for prone, kneeling and standing in accordance with three position rule book.

Figure 3:
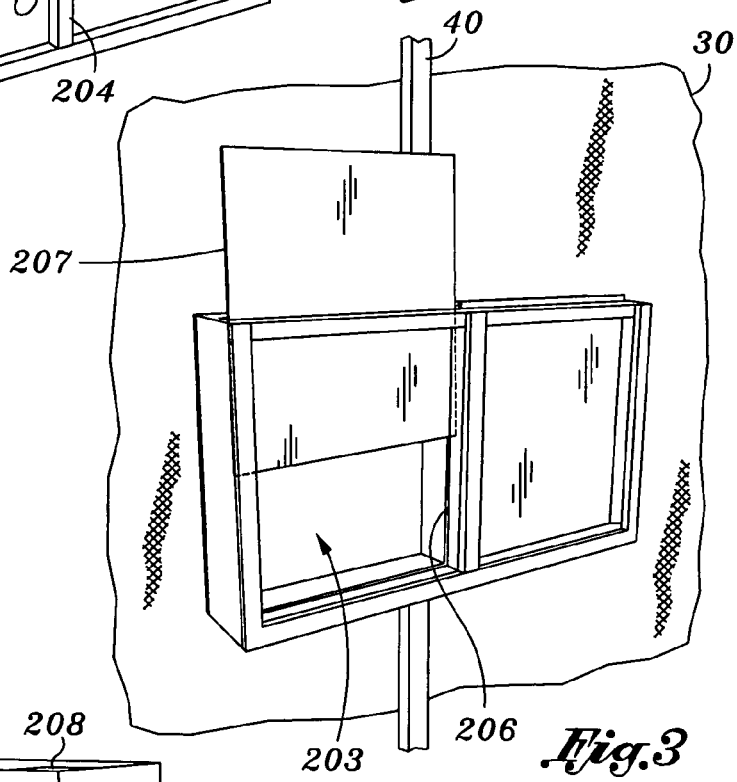
FIG. 3 shows the installation of the impact plate to the target box.

As shown in FIGS. 1-3, the front surface 201 of the target box 20 includes two separate plates each being perforated with a plurality of holes 201A. Preferably, each of the chambers includes an open slit on a top surface thereof and a groove along the interior surface of the side and bottom surfaces thereof to form a slot 206 about 1" behind the target surface 201, such that a cardboard 207 can be disposed between the target surface 201 and an impact plate 203. The impact plate 203 is preferably a ⅛" piece of plate that rests flush against the back panel of the target box 20. The impact plates 203 include a 3 mm Brinnel rating 500 impact resistant armor plate (which meets with the Marine Corps Range Safety Office requirement of 360/400), for example. In the unlikely event of a bounce back, the cardboard 207 reduces of the velocity of the pellet to a point where it will not come back through the paper target. By keeping the expended pellets in the enclosed chamber area between the cardboard 207 and the impact plate 203, the operation of changing the target become cleaner. In addition, as shown in FIGS. 1, 2 and 4, the outermost corner of each of the top surfaces is perforated with a drain hole 208. The operation of emptying the chamber thus becomes a lesser messy task by channeling the expended pellets into drain holes located in the uppermost corner of each chamber.

Figure 5:
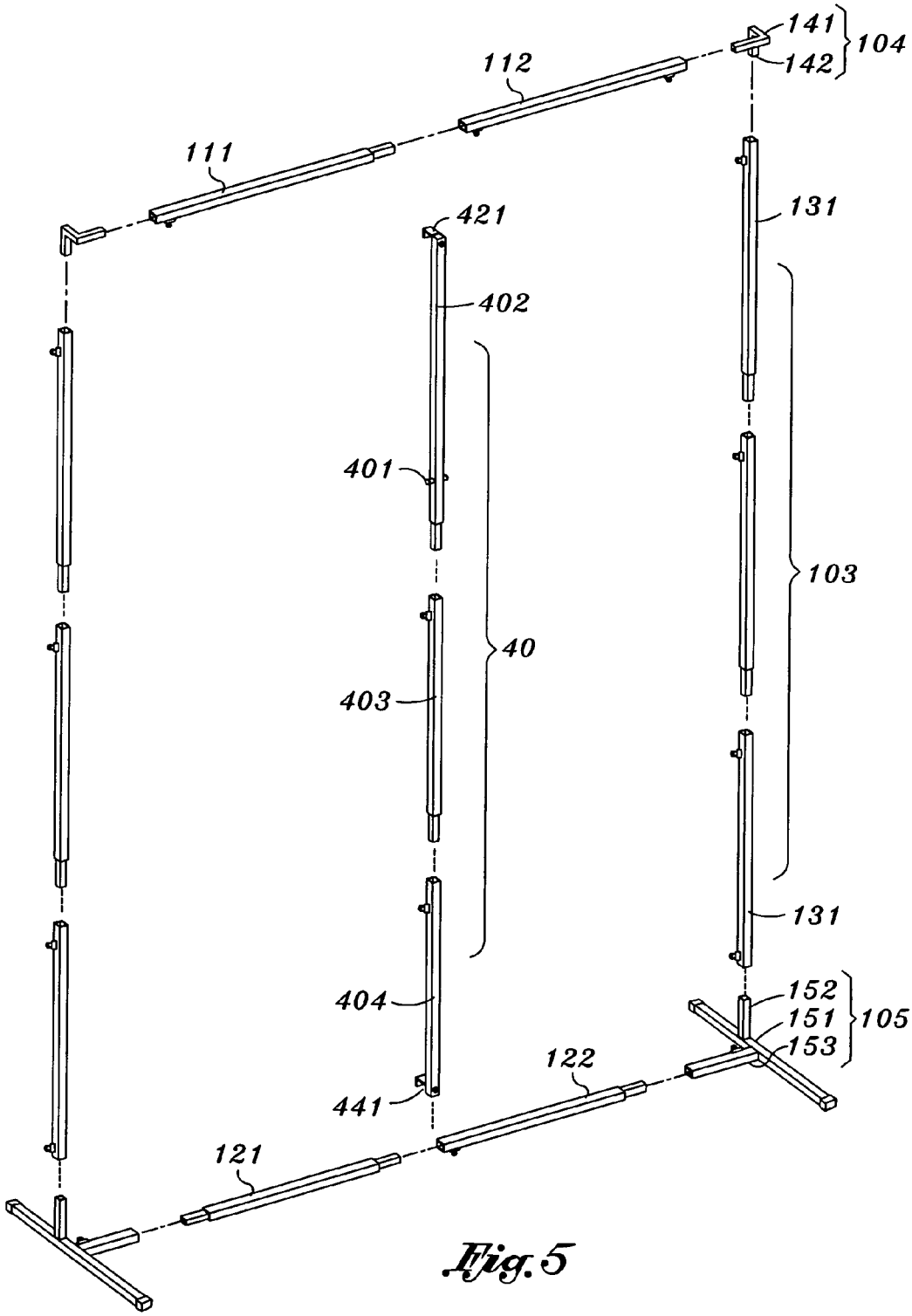
FIG. 5 shows the assembly of the support frame.

Referring to FIG. 5, the top horizontal side 101 can be dissembled into a bar 111 with a male connecting end and a female connecting end and a bar 112 with two female connecting ends. The male end of the bar 111 is engaged with one female end of the bar 112 and tightened by a bolt 50, while the female end of the bar 111 and the other male end of the bard 112 are to receive the open ends of the horizontal elbows 142 of the respective top corner pieces 104. Each of the vertical sides 103 is assembled by three identical bars 131 each being terminated with one female connecting end on the top and one male connecting end at the bottom. Therefore, the topmost bar 131 of each vertically side 103 is able to receive and engage with the vertical leg 141 of the respective upper corner piece 104 by a bolt 50. As shown in FIG. 5, the horizontal elbow 141 and the vertical leg 142 are connected to each other to form the upper corner piece 104. Preferably, the horizontal elbow 141 and the vertical leg 142 are integrally formed. Each of the stands or bases 105 includes a horizontal bar 151, a female vertical connection member 152 extending vertically from the horizontal bar 151, and a female horizontal connection member 153 extending horizontally and perpendicularly from the horizontal bar 151. Preferably, the female horizontal connection member 153 extends substantially from a center of the horizontal bar 151, while the female vertical connection member 152 extends from between the center and one end of the horizontal bar 151. The bottom horizontal side 102 is assembled by two bars, including one horizontal bar 121 with two male connection ends and one horizontal bar 122 with one female end to connect one male end of the bar 121 and one male end to be received by the horizontal connection member 152 of one of the stands 105.

The central target pole 40 can be dissembled into three vertical bars, including a top vertical bar 402, a middle vertical bar 403 and a bottom vertical bar 404. The top vertical bar 402 further includes a horizontal lug 421 extending horizontally from the top end thereof for connecting and engaging with substantially a center of the top horizontal side 101 by a bolt 50. Similarly, the bottom vertical bar 404 includes a horizontal lug 441 extending horizontally from the bottom end thereof for connecting and engaging with substantially a center of the bottom horizontal side 102 by a bolt 50. As discussed above, the central target pole 40 further comprises at least a pair of laterally and horizontally extending roll pins 401 for hanging the target box 20. In an alternate embodiment, the air gun range may include three pairs of roll pins 401 or other hooking devices for hanging three target boxes 20, such that the user does not need to adjust the height of the targets 20 according to the three position rule.

As shown in FIG. 1, the curtain 30 includes a flat piece with a profile conformal to the support frame 10. The curtain 30 is preferably made of high-density ballistic nylon able to withstand multiple impacts from pellets with a muzzle velocity up to 600 fps. Preferably, the edge of the curtain 30 is attached with attaching means such as Velcro, button, and strings, such that multiple curtains 30 can be joined with each other over a desired width. Further, as shown in FIG. 1, the top edge of the curtain 30 is secured to at least the top horizontal side 101. As the central target pole 40 extend farther away from the vertical sides 103 than the top horizontal side 101, the curtain 30 will be hung behind the central target pole 40, that is, behind the target box 20 as shown in FIG. 1.

Preferably, the horizontal top and bottom sides 101 and 102, the vertical sides 103, the upper corner pieces 104, the bottom stands 105, and the central target pole 40 are made of heavy-duty steel tubes with a cross section of about 0.095 square inches and power coated for corrosion resistance. Each individual part of the support frame 10 is preferably marked or printed with identification, such that the user can easily assemble the individual parts into the support frame 10.

The above description is given by way of example, and not limitation. Given the above disclosure, one skilled in the art could devise variations that are within the scope and spirit of the invention disclosed herein. Further, the various features of the embodiments disclosed herein can be used alone, or in varying combinations with each other and are not intended to be limited to the specific combination described herein. Thus, the scope of the claims is not to be limited by the illustrated embodiments.

What is claimed is:

1. An air gun range, comprising a support frame, comprising a plurality of bars detachably connected together;

a central vertical pole detachably connected to substantially centers of a top side and a bottom side of the support frame;

a curtain made of high-density ballistic material and removably attached to the support frame to vertically extend between the support frame and the central vertical pole; and a target box removably attached to the central vertical pole.

2. The air gun range of claim 1, wherein the support frame further comprises:

a pair of vertical sides;

a horizontal top side with two opposing ends connected to top ends of the respective vertical sides; and a horizontal bottom side with two opposing ends connected to bottom ends of the respectively vertical sides.

3. The air gun range of claim 2, wherein the support frame further comprises a pair of upper corner pieces for connecting the horizontal top side to the vertical sides.

4. The air gun range of claim 3, wherein each of the upper corner pieces is bent into a horizontal connection member for connecting the top horizontal side and a vertical connection member for connecting the respective vertical side.

5. The air gun range of claim 2, further comprising a pair of bottom stands for connecting the vertical sides to the bottom horizontal side.

6. The air gun range of claim 5, wherein each of the bottom stands further comprises:

a horizontal bar to extend perpendicularly to the bottom horizontal side;

a horizontal connection member extending horizontally and perpendicularly from the horizontal bar; and a vertical connection member extending vertically from the horizontal bar.

7. The air gun range of claim 6, wherein the horizontal connection member extends from substantially a center of the horizontal bar, and the vertical connection member extends from between the center and one end of the horizontal bar.

8. The air gun range of claim 1, further comprising a plurality of bolts for tightening the bars to form the support frame.

9. The air gun range of claim 1, wherein the central target pole further comprises a plurality of bars secured to each other.

10. The air gun range of claim 1, wherein the central target pole further comprises a top lug extending horizontally from a top end thereof and a bottom lug extending horizontally from a bottom end thereof.

11. The air gun range of claim 10, wherein the top and bottom lugs are engaged with the top and bottom horizontal sides by bolts.

12. The air gun range of claim 1, wherein the bars are made of heavy-dutysteel tubes.

13. The air gun range of claim 12, wherein the bars are configured into square tubes with cross section areas of about 0.095 square inches.

14. The air gun range of claim 1, wherein the support frame and the central target pole are power coated for corrosion resistance.

15. The air gun range of claim 1, wherein the curtain is made of high-density ballistic nylon.

16. The air gun range of claim 1, wherein the curtain is made of a material operative to withstand impacts from pellets with a muzzle velocity up to 600 fps.

17. The air gun range of claim 1, wherein the curtain includes an edged Velcro, such that multiple curtains can be attached to the support frame.

18. The air gun range of claim 1, wherein the target box is partitioned into two chambers by a central plate.

19. The air gun range of claim 18, wherein each of the chambers is covered with a target surface perforated with a plurality of holes.

20. The air gun range of claim 19, wherein each chamber further includes an impact plate disposed behind the target surface.

21. The air gun range of claim 20, wherein each chamber further comprises a slot for disposing cardboard between the target surface and the impact plate.

22. The air gun range of claim 21, wherein each of the chambers further includes a drain hole formed at an upper corner thereof and behind the cardboard.

23. The air gun range of claim 20, wherein the impact plates have a thickness of 3 mm and a Brinnel rating of 500.

* * * * *